US006439213B2

(12) United States Patent
Bircann et al.

(10) Patent No.: US 6,439,213 B2
(45) Date of Patent: Aug. 27, 2002

(54) SHAFT LEAKAGE ARRESTING SYSTEM FOR A GAS MANAGEMENT VALVE

(75) Inventors: Raul A. Bircann, Penfield; Dwight O. Palmer, Rochester, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 4 days.

(21) Appl. No.: 09/788,741

(22) Filed: Feb. 20, 2001

Related U.S. Application Data

(60) Provisional application No. 60/184,513, filed on Feb. 24, 2000, and provisional application No. 60/184,533, filed on Feb. 24, 2000.

(51) Int. Cl.[7] ..... F02M 25/02
(52) U.S. Cl. ..... 123/568.21; 251/129.15
(58) Field of Search ..... 123/568.21; 251/129.15; 60/605.2

(56) References Cited

U.S. PATENT DOCUMENTS 1,271,670 A * 7/1918 Conrad ..... 251/129.15
5,129,623 A * 7/1992 Lockwood ..... 251/324
5,460,146 A * 10/1995 Frankenberg ..... 123/568.21
5,511,531 A * 4/1996 Cook et al. ..... 123/568.21
5,704,585 A * 1/1998 Hrytzak et al. ..... 251/129.15
5,722,634 A * 3/1998 Hrytzak et al. ..... 251/129.15
5,779,220 A * 7/1998 Nehl et al. ..... 251/129.15
5,984,263 A * 11/1999 Hosoya ..... 251/129.15
6,119,725 A * 9/2000 Shinobu et al. ..... 251/129.15
6,213,447 B1 * 4/2001 Bircann et al. ..... 251/84
6,217,001 B1 * 4/2001 Gluchowski et al. .. 251/129.07
6,230,742 B1 * 5/2001 Bircann ..... 251/86
6,247,461 B1 * 6/2001 Smith et al. ..... 251/129.15

* cited by examiner

*Primary Examiner*—Paul J. Hirsch
(74) *Attorney, Agent, or Firm*—John Vanophem

(57) ABSTRACT

A leakage arresting system comprising a novel gas arrestor for installation on an interrupted pintle shaft in a pintle-type valve, such as an exhaust gas recirculation valve for an internal combustion engine, for preventing leakage of gas and moisture along the pintle shaft into the actuator, to prevent corrosion and failure of the actuator. The system comprises two elements: a pintle shaft which is interrupted outside the actuator, and a positive vapor block in the form of a cup-shaped arrestor disposed across the pintle interruption. The invention is applicable to both unbalanced and force-balanced valves.

6 Claims, 3 Drawing Sheets

SHAFT LEAKAGE ARRESTING SYSTEM FOR A GAS MANAGEMENT VALVE

CROSS-REFERENCE TO RELATED APPLICATIONS

This application claims the benefit of U.S. Provisional Application Serial No. 60/184,513, filed February 24, 2000 and U.S. Provisional Application Serial No. 60/184,533, filed February 24, 2000.

TECHNICAL FIELD

The present invention relates to pintle-type valves; more particularly to solenoid-actuated pintle valves for permitting the controlled admission of exhaust gases into the fuel intake manifold of an internal combustion engine; and most particularly to a system including an interrupted pintle and gas arrestor for preventing entrance of corrosive gases and moisture into the valve actuator.

BACKGROUND OF THE INVENTION

It is well known in the automotive art to provide a variable valve connecting the exhaust manifold with the intake manifold of an internal combustion engine to permit selective and controlled recirculation of a portion of an engine's exhaust gas into the fuel intake stream. Such recirculation is beneficial for reducing the burn temperature of the fuel mix in the engine to reduce formation of nitrogen and sulfur oxides which are significant components of smog. Such a valve is known in the art as an exhaust gas recirculation (EGR) valve.

Typically, an EGR valve has a valve body enclosing a chamber disposed between a first port in the exhaust manifold and a second port in the intake manifold; a valve seat dividing the chamber between the two ports; a pintle shaft having a valve head fitted to the valve seat and extending from the valve head through a bearing mounted in a third port in a sidewall of the valve body; a spring-retained bearing splash shield; and a solenoid actuator mounted on the exterior of the valve body and having an armature into which the outer end of the valve pintle extends.

A problem inherent to EGR valve applications is that the managed fluid (exhaust gas) is moisture-laden, corrosive, and dirty. If this gas enters the actuator, for example, by leaking along the pintle shaft, then internal corrosion, malfunction, and ultimate failure of the actuator can result. Such failure can lead to emission non-compliance and can incur significant cost to a vehicle manufacturer if a recall is required. Two known solutions to this problem are a sealed, impermeable actuator, or, alternatively, an actuator having working components which are unaffected by exhaust gas. Either of such actuators is currently impractical for cost and performance reasons. Further, a sealed actuator would be even more vulnerable to damage from trapped moisture if a leak should develop in the seal; and a corrosion-resistant actuator would require materials of construction which are less magnetically efficient than the currently used soft iron and powder metals, thus dictating a substantially larger solenoid.

What is needed is a gas arrestor between an EGR valve and actuator that prevents gas and moisture intrusion into the actuator without impairing efficiency, size, and performance of the valve and actuator. Preferably, such an arrestor is simple and inexpensive to fabricate and install.

SUMMARY OF THE INVENTION

The present invention is directed to a leakage arresting system comprising a novel gas arrestor for installation on an interrupted pintle shaft in a pintle-type valve, such as an exhaust gas recirculation valve for an internal combustion engine, for preventing leakage of gas and moisture along the pintle shaft into the actuator to prevent corrosion and failure of the actuator. The system comprises two elements: a pintle shaft which is interrupted outside the actuator, and a positive vapor block in the form of a cup-shaped arrestor disposed across the pintle interruption. The invention is applicable to both unbalanced and force-balanced valves.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings, in which.

DESCRIPTION OF THE PREFERRED EMBODIMENT

Figure 1:
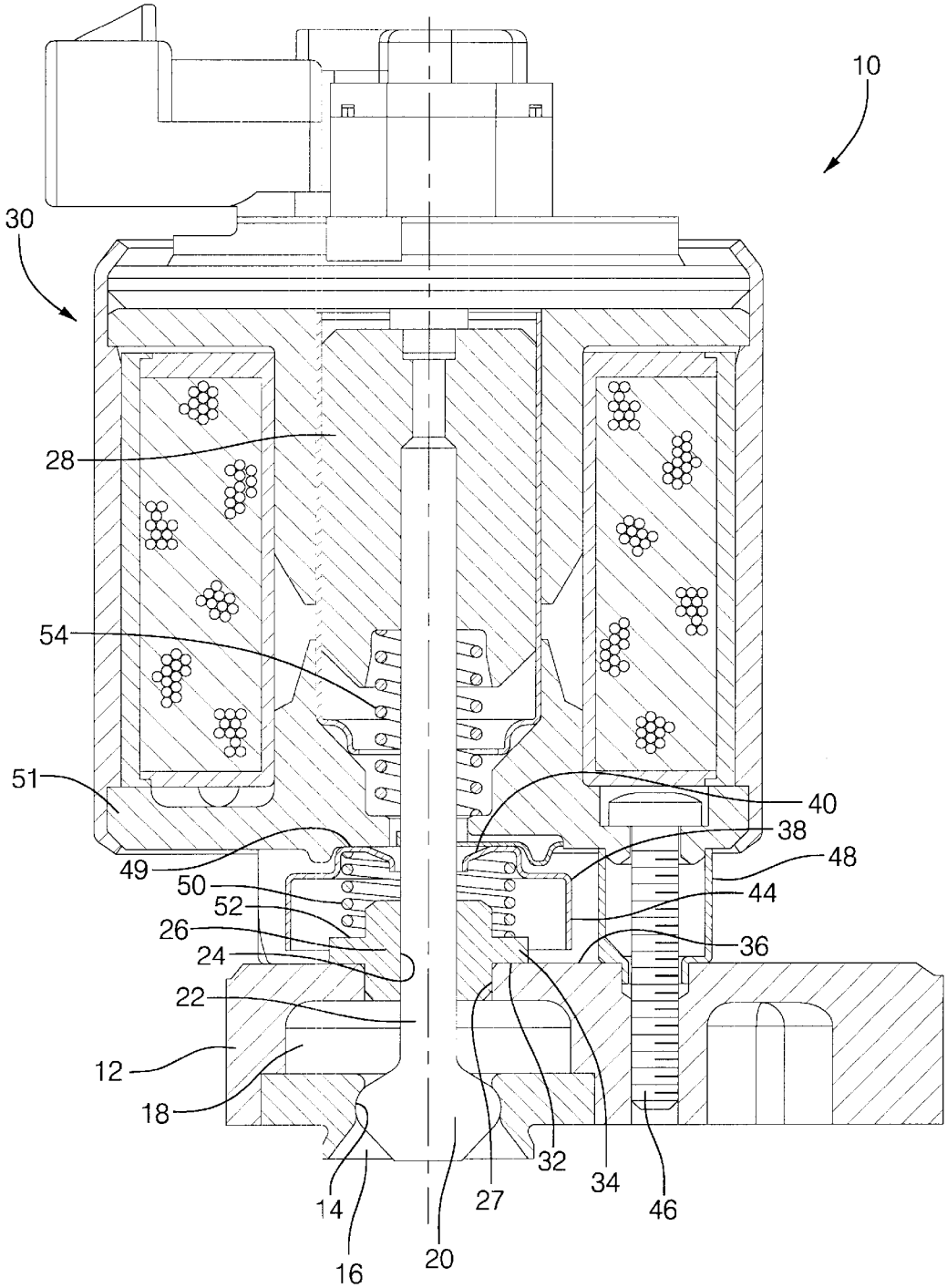
PRIOR ART FIG. 1
FIG. 1 is an elevational cross-sectional view of a prior art EGR valve.

The benefits afforded by the present invention will become more readily apparent by first considering a prior art pintle valve. Referring to FIG. 1, a prior art EGR valve 10 includes a valve body 12 having a valve seat 14 separating a first chamber 16 from a second chamber 18, which chambers may communicate with the exhaust and intake systems, respectively, of an internal combustion engine (not shown) or the reverse. Valve head 20 is disposed adjacent to seat 14 for selectively mating therewith to open or to close communication between chambers 16 and 18. Valve pintle shaft 22 extends from head 20 through an axial bore 24 in bearing 26 and is captured within armature 28 of solenoid actuator 30. Bearing 26 is disposed in a port 27 in a wall of valve body 12 and guides shaft 22 in reciprocating motion to open and close the valve when actuator 30 is energized and de-energized, respectively.

Bearing 26 is provided with a circumferential flange 32 having an axial face 34 for sealing against axial outer surface 36 of valve body 12 to prevent leakage of gases therebetween. A cup-shaped bearing splash shield 38 has an inward-extending flange 40 with a central aperture for passage of shaft 22, preferably without contact therebetween, and a cylindrical skirt 44 extending axially to shield a substantial portion of bearing 26 from external contaminants. Shield 38 is open in a downwards direction to permit venting of any gases which may leak along bore 24 during operation of the valve. Actuator 30 is connected to valve body 12 via a plurality of bolts 46 extending through a plurality of standoffs 48. A coil spring 50 surrounding pintle shaft 22 is disposed within shield 38, being compressed between actuator 30 and a second surface 52 on flange 32 for urging flange 32 to seal against surface 36 under all operating conditions. Spring 50 also serves to urge shield 38 against surface 49 of primary polepiece 51 of actuator 30 to inhibit dust intrusion into the actuator.

A second spring 54 disposed in compression within actuator 30 between armature 28 and polepiece 51 keeps valve 10 in the normally-closed position shown in FIG. 1 when the solenoid is de-energized, pintle shaft 22 thus being under tension. When the valve is opened, by energizing of the actuator, pintle shaft 22 is subjected to compressive force, an important consideration in providing an interrupted pintle shaft and gas arrestor in accordance with the invention.

Figure 2:
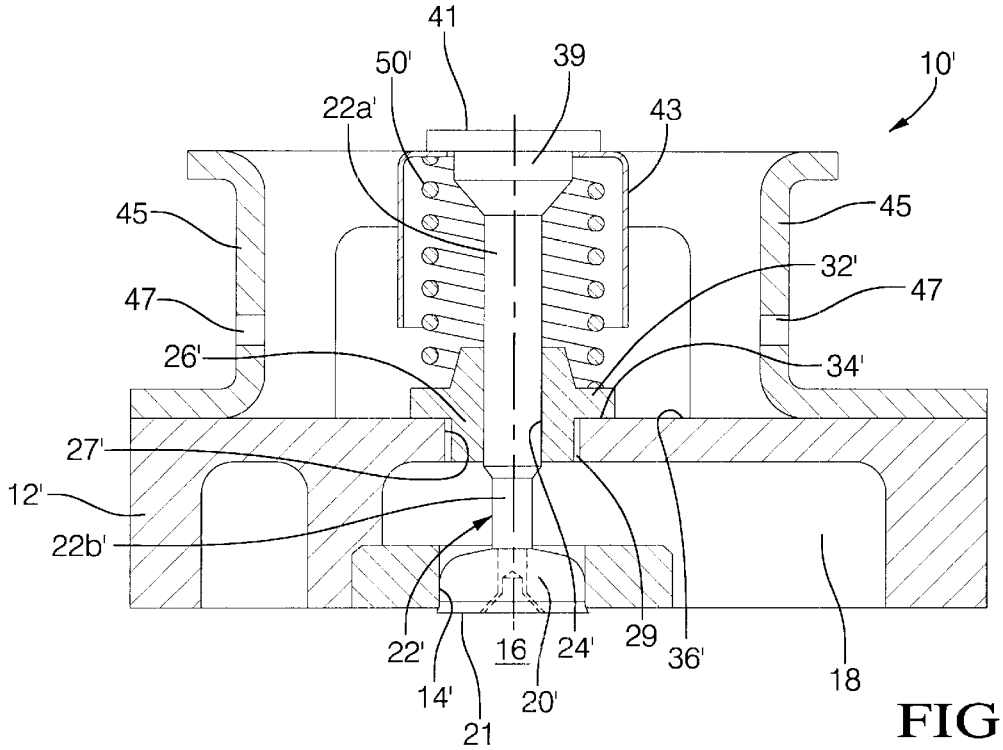
FIG. 2 is an elevational cross-sectional view of a valve like that shown in FIG. 1 equipped with an interrupted pintle shaft and a gas arrestor in accordance with the invention.

Referring to FIG. 2, an improved valve 10' in accordance with the invention is shown, for clarity without an actuator. Like prior art valve 10, valve 10' has a valve body 12' having a valve seat 14' separating a first chamber 16 (outside of the valve body in this embodiment but analogous to chamber 16 in FIG. 1) from a second chamber 18. Valve head 20' having a mating element 21 attached thereto as by any conventional means is disposed adjacent to seat 14' for selectively mating therewith to open or to lose communication between chambers 16 and 18. Pintle shaft 22' extends from head 20' through an axial bore 24' in bearing 26'. Bearing 26' is disposed in a port 27' in a all of valve body 12' and guides pintle shaft 22' bin reciprocating motion to open and close the valve when the actuator (not shown) is energized and de-energized, respectively. Bearing 26' is provided with a circumferential flange 32' having a first axial face 34' for sealing against axial outer surface 36' of valve body 12' to prevent leakage of gases therebetween. Preferably, the diameter of port 27' is slightly greater than the diameter of the corresponding portion of bearing 26', providing a gap 29 therebetween, such that the bearing may be radially compliant to accommodate axial misalignments of other valve components.

For ease of assembly, pintle shaft 22' may be provided in upper and lower sections **22'*a*,22'*b* which are threaded appropriately to screw together to form pintle shaft 22'. Alternatively, pintle shaft 22' may be provided as a one-piece element, and the metering head may be attached conventionally. Pintle shaft 22' terminates in a flared portion 39 having a flat outer surface 41**.

A gas arrestor 43, cup-shaped and inverted downwards, has a central aperture for receiving portion 39. Arrestor 43 is readily and inexpensively formed as by stamping from sheet metal. A coil spring 50' is disposed in compression around pintle shaft **22*a*' between bearing flange 32' and the underside of arrestor 43, urging the arrestor into sealing contact with the underside of flared portion 39. Actuator standoffs 45 are attached to valve body 12' and are provided with one or more vents 47**.

Gases which may leak from chamber 18 along pintle shaft **22*a*' through bore 24' are thus positively precluded from migrating past arrestor 43 and instead are directed by arrestor 43 back toward valve body 12' and are allowed to escape through vents 47**.

Figure 4:
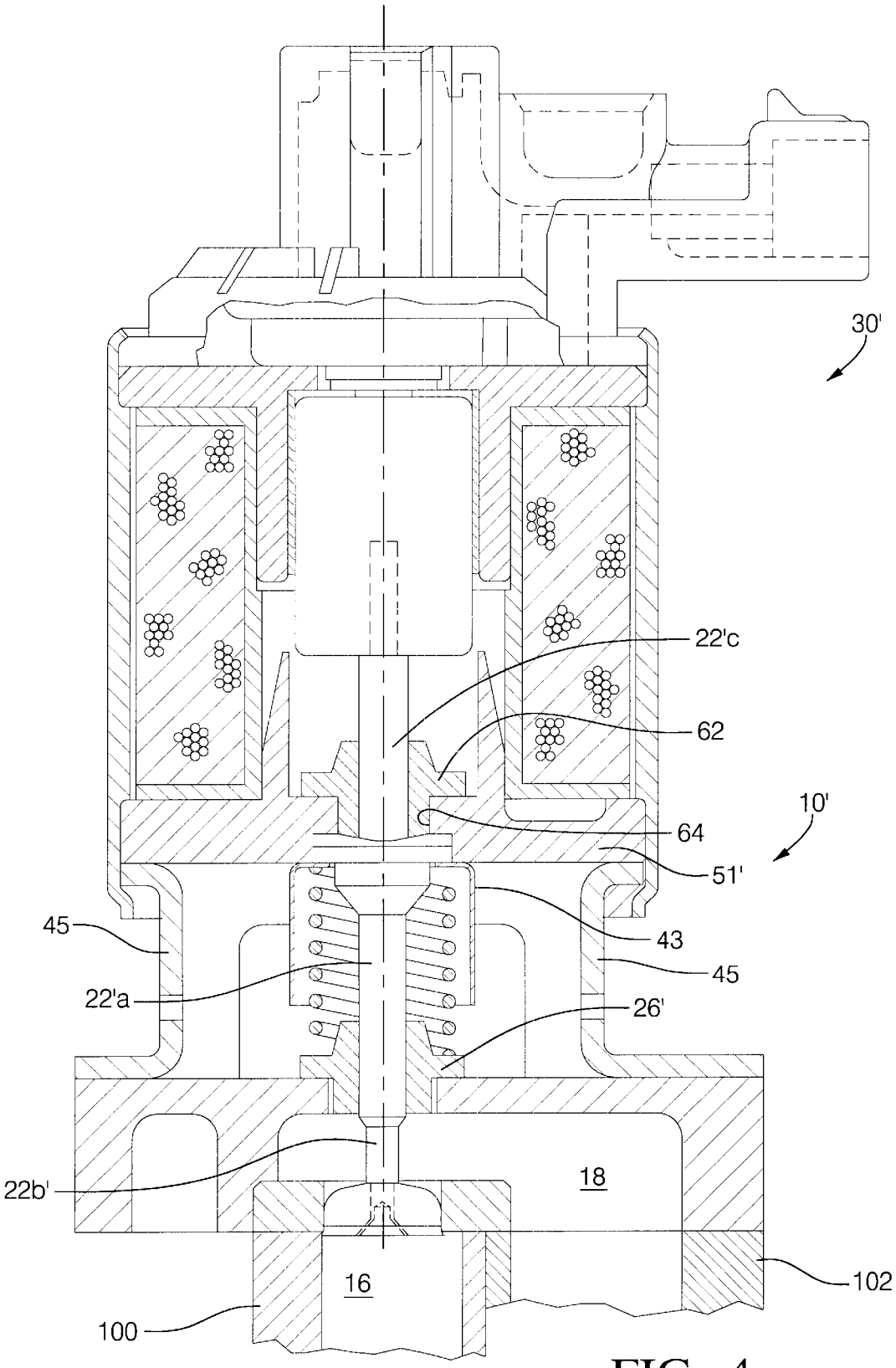
FIG. 4 is an elevational cross-sectional view of the valve shown in FIG. 2 mounted onto an actuator modified for an interrupted pintle shaft.

Referring to FIG. 4, the valve 10' just described and shown in FIG. 2 is here shown fully attached to an actuator 30' modified as necessary to interface with the shortened pintle shaft 22'. Valve 10' is shown mounted for use as an exhaust gas recirculation (EGR) valve on an internal combustion engine 104, exhaust manifold 100 and intake manifold 102 being attached to valve 10' adjacent chambers 16 and 18, respectively. With respect to actuator 30', second spring 54 is eliminated. The outer portion of pintle shaft 22 extending into and captured by armature 28 is replaced by a stub shaft, or pintle lifter, **22'*c* which makes contact with but is not connected to surface 41. Thus, the combination of pintle shaft elements 22'*a*, 22'*b*, and 22'*c* may be thought of as an "interrupted" pintle shaft having a positive gas-arresting break between elements 22'*b* and 22'*c*. Pintle lifter 22'c is radially supported and guided by a new flanged bearing 62, similar to bearing 26', disposed preferably as a press fit in a new axial bore 64 in modified polepiece 51'. Preferably, the length of lifter 22'*c* in the bearing is at least 1.5 times the diameter of lifter 22'*c* to inhibit potential ingress of gas and moisture into actuator 30' through bearing 62**.

Because valve head 20' is urged towards the closed valve position by spring 50', armature 28 and pintle lifter **22'*c* act on pintle shaft 22'** only under compression.

Because surface 41 presents a relatively broad contact surface for pintle lifter **22'*c*, the axial alignment of actuator 30' with valve 10' is significantly relaxed over the tight tolerance required in prior art valve 10**.

Figure 3:
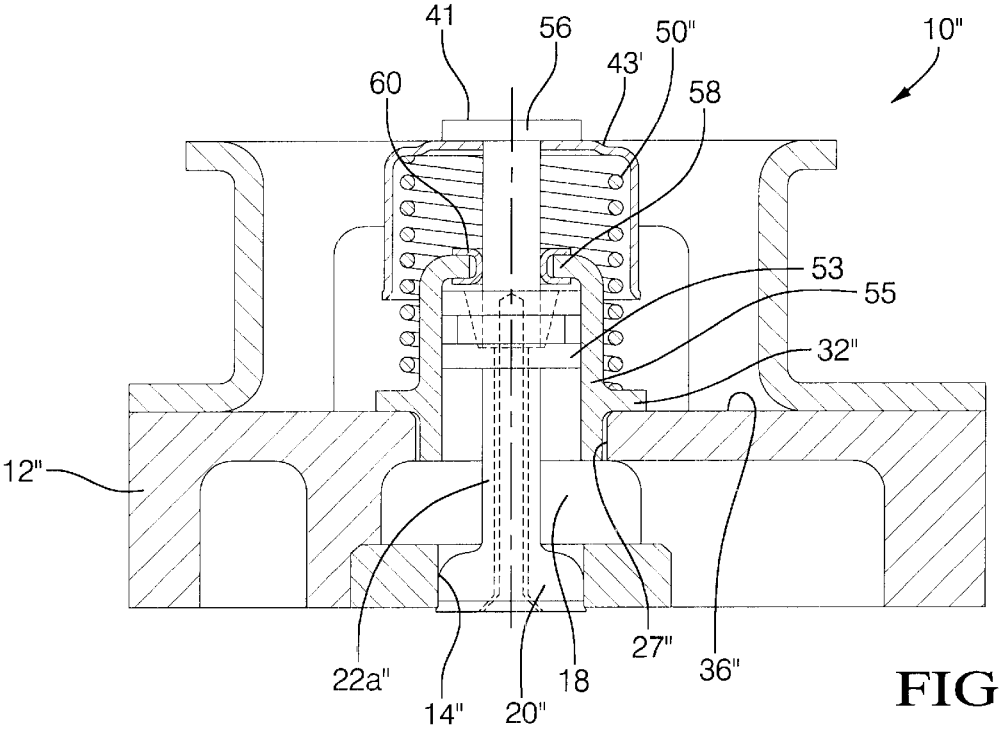
FIG. 3 is a view like that shown in FIG. 2, showing the invention adapted to a force-balanced valve.

Referring to FIG. 3, a second embodiment 10" of a valve with a gas arrestor in accordance with the invention is configured as a force-balanced valve. Valve 10' is not force-balanced in that pressure or vacuum in chamber 18 exerts an opening or closing force on the back side of valve head 20' which must be overcome by spring 50' for the valve to remain closed or by actuator 30' for the valve to open. Thus, the operating range of valve 10' is limited to pressures below the spring force of the closing spring and the solenoid force of the actuator. In valve 10", however, a piston 53 having a cross-sectional area substantially equivalent to the area of valve head 20' is disposed on pintle shaft **22*a*" in opposition to head 20' such that the opening or closing force exerted on head 20' is balanced by an equal closing or opening force exerted on piston 53. Thus valve 10" may be used over a broader range of internal pressures than valve 10'**.

In valve 10", piston 53 effectively takes the place of bearing 26' in guiding the pintle shaft in the valve. A piston cylinder 55 is disposed in a bore 27" in valve body 12" to be radially-compliant as described above for bearing 26' in valve body 12'. Cylinder 55 is provided with a flange 32" for supporting and sealing against surface 36". Piston 53 is slidingly disposed within cylinder 55, the diametral tolerance between piston 53 and cylinder 55 being as small as possible without causing significant drag therebetween. Pintle shaft **22*a*" extends beyond piston 53 and is terminated in a broad, flat cap 56 having an upper surface 41. A second embodiment 43' of a gas arrestor is disposed on shaft 22*a*" and a coil spring 50" in compression is captured between arrestor 43' and flange 32", again for urging arrestor 43' sealingly against cap 56 and for urging head 20" into closed relationship with seat 14". Because the cylindrical surface area of piston 53 is substantially greater than the surface area of shaft 22*a*' in valve 10', the potential for leakage along the piston surface is also substantial. Therefore, cylinder 55 preferably is provided with an inwardly curved flange 58 for receiving a shaft seal 60 which may be formed from an appropriate material, for example, an elastomer, metal, or polymer, and disposed with minimal radial pressure on shaft 22**a".

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. In a gas management pintle valve having a valve body and an actuator attached to the valve body, a system for arresting gas leakage from the valve body along a pintle shaft, comprising:

a) a first pintle shaft portion extending from said valve body towards said actuator and terminating at an end outside of said actuator;

b) a gas arrestor disposed on said first pintle shaft portion near said end for arresting gas leakage along said shaft portion; and c) a second pintle shaft portion disposed within and extending from said actuator and axially operative by said actuator against said end of said first pintle shaft portion to axially displace said first shaft portion.

2. A gas management pintle valve having a system for preventing pintle shaft leakage of gas from the body of the valve into the actuator thereof, comprising:

a) a valve body having a chamber having a first port defining a valve seat, a bore opposite said first port, and an axial shaft bearing disposed in said bore;

b) a valve head disposed in said chamber for mating with said valve seat to open and close said first port;

c) a first portion of a pintle shaft connected at a first end to said valve head, extending through said bearing, and terminating at a second end;

d) a gas arrestor disposed on said first portion of said pintle shaft near said second end; and e) a solenoid actuator attached to said valve body and having a second portion of the pintle shaft disposed within and extending from said actuator and being axially operative by said actuator against said second end of said first pintle shaft portion to axially displace said first shaft portion to open and close said valve.

3. A valve in accordance with claim 2 wherein said valve is an exhaust gas recirculation valve in an internal combustion engine.

4. A valve in accordance with claim 2 wherein said gas arrestor comprises a cup-shaped element open towards said valve body and having a central aperture for receiving said first pintle shaft portion.

5. A valve in accordance with claim 2 further comprising a compression spring disposed between said gas arrestor and said bearing for sealingly urging said arrestor against said first pintle shaft portion.

6. An internal combustion engine, comprising;

a) an intake manifold;

b) an exhaust manifold; and c) an exhaust gas recirculation valve connected to controllably pass exhaust gas from said exhaust manifold to said intake manifold, said valve including i) a valve body having a chamber having a first port defining a valve seat, a bore opposite said first port, and an axial shaft bearing disposed in said bore;

ii) a valve head disposed in said chamber for mating with said valve seat to open and close said first port;

iii) a first portion of a pintle shaft connected at a first end to said valve head, extending through said bearing, and terminating at a second end;

iv) a gas arrestor disposed on said first portion of said pintle shaft near said second end; and v) a solenoid actuator attached to said valve body and having a second portion of a pintle shaft disposed within and extending from said actuator and being axially operative by said actuator against said second end of said first pintle shaft portion to axially displace said first shaft portion to open and close said valve.

* * * * *